United States Patent [19]

Naku

[11] Patent Number: 4,995,417

[45] Date of Patent: Feb. 26, 1991

[54] ONE-PIECE TIRE VALVE ADAPTOR

[75] Inventor: Virgil Naku, Hawthorne, N.Y.

[73] Assignee: Precision Valve Corporation, Yonkers, N.Y.

[21] Appl. No.: 503,231

[22] Filed: Apr. 2, 1990

[51] Int. Cl.[5] ..... F16K 15/20

[52] U.S. Cl. ..... 137/231; 137/614.02; 137/614.03; 251/144; 141/349; 141/387

[58] Field of Search ..... 137/231, 614.02, 614.03, 137/614.04; 251/144, 149.7; 141/38, 346, 349, 383, 387, 388, 389

[56] References Cited

U.S. PATENT DOCUMENTS

| | | | |
|---|---|---|---|
| D. 167,213 | 7/1952 | Lapin | D58/17 |
| D. 294,114 | 2/1988 | Beck | D9/300 |
| 1,166,415 | 12/1915 | Tyler | 137/231 |
| 1,301,508 | 4/1919 | Schroder | 137/231 |
| 1,359,795 | 11/1920 | Delahey et al. | 137/231 X |
| 2,027,956 | 1/1936 | Bowser | 137/231 |
| 2,457,052 | 12/1948 | LeClair | 137/614.04 |
| 2,498,596 | 2/1950 | Wallach | 141/383 X |
| 2,821,048 | 1/1958 | Efford | 47/1.01 |
| 2,906,440 | 9/1959 | Focht | 222/402.31 |
| 2,925,103 | 2/1960 | Kerr et al. | 141/349 |
| 3,035,617 | 5/1962 | Breitenstein | 141/349 |
| 3,131,733 | 5/1964 | Monahon | 141/349 |
| 3,144,057 | 8/1964 | O'Donnell | 141/354 |
| 3,249,261 | 5/1966 | Benediktson | 222/190 |
| 3,329,180 | 7/1967 | Van Brocklin | 141/349 |
| 3,404,814 | 10/1968 | Wakeman | 222/402.13 |
| 3,448,779 | 6/1969 | Horwitt | 141/349 X |
| 3,476,136 | 11/1969 | Weisgerber | 137/231 |
| 3,508,572 | 4/1970 | Paffrath | 137/231 |
| 3,568,736 | 3/1971 | Linch et al. | 141/349 |
| 3,718,312 | 2/1973 | Payne | 137/231 X |
| 3,762,611 | 10/1973 | Nigro | 222/402.13 |
| 3,881,531 | 5/1975 | Rossi | 137/231 X |
| 3,907,012 | 9/1975 | Burke | 141/349 |
| 3,970,122 | 7/1976 | Scott | 141/349 |
| 3,976,110 | 8/1976 | White | 141/346 |
| 4,165,760 | 8/1979 | Guenther | 137/231 |
| 4,168,015 | 9/1979 | Robinette | 222/3 |
| 4,193,419 | 3/1980 | Pellerito | 137/614.03 X |
| 4,277,004 | 7/1981 | Barlics | 220/402.14 |
| 4,644,982 | 2/1987 | Hatch | 141/383 |
| 4,664,153 | 5/1987 | Bishop | 137/231 X |
| 4,895,190 | 1/1990 | Gillen | 141/383 X |
| 4,930,648 | 6/1990 | Hundt | 220/1 B |

FOREIGN PATENT DOCUMENTS

| | | | |
|---|---|---|---|
| 668429 | 3/1952 | United Kingdom | 137/231 |
| 1084253 | 9/1967 | United Kingdom . | |

*Primary Examiner*—John Rivell

*Attorney, Agent, or Firm*—Davis Hoxie Faithfull & Hapgood

[57] ABSTRACT

A one piece tire valve adaptor for connection to an aerosol container including a base with a means for attachment to a mounting cup, a hollow tube connected to said base and including a spout for connection to a tire valve, and a flow passage extending from said first end to said second end. The spout includes three sealing surfaces for engaging three surfaces of the tire valves, to prevent air leakage during inflation. The flow passage includes a post centrally located within said flow passage and extending into said spout, for engaging the pin of a tire valve. The base further includes a flexible diaphragm connected to the first end of said tube. Sufficient pressure on said spout of the adaptor flexes the diaphragm, causing the tube of the adaptor to engage and push the actuator into the aerosol container, opening the valve of the container. The release of pressure on the spout allows the diaphragm to return to its original position, causing the tube to allow the valve to close.

30 Claims, 3 Drawing Sheets

ONE-PIECE TIRE VALVE ADAPTOR

FIELD OF THE INVENTION

A tire valve adaptor, and, more particularly, a one piece tire valve adaptor for connection to an aerosol container with an improved sealing means.

BACKGROUND

Portable containers of pressurized gas have become common for emergency tire inflation. The traditional spare tire mounted on a wheel and stored inflated is being replaced by a much less bulky mounted emergency tire which can be inflated with a container of compressed gas. Tires low on air can also be filled with such containers. Other inflatable devices utilizing a tire valve, such as floats, can be similarly inflated.

A tire valve includes a short pipe with external threading, surrounding a valve mechanism. The valve mechanism includes a pin or stem which is depressed to open the valve. Conventional aerosol pressurized containers filled with liquified gas, such as butane, have been fitted with adaptors for connection to the tire valve.

The adaptor should be capable of swift attachment and detachment to the tire valve to avoid loss of gas. It should also be free of leakage and adequately secure once connected to resist inadvertent disconnection during inflation. Since the user may be inexperienced and working under stress or in the dark, the adaptor should also be simple to use.

SUMMARY OF THE INVENTION

The present invention provides a one piece connector or adaptor for attachment to an aerosol container comprising a base with a means for attachment to a standard mounting cup of an aerosol container. A hollow tube is connected to the base of its first end. A second end of the tube comprises a spout for connection to a tire valve. A flow passage extends from the first end to the second end.

The spout includes a sealing means providing a circumferential inner wall for engaging the threaded portion of a tire valve, an opposing wall essentially parallel to the inner wall, for engaging the inner surface of the threaded portion of the tire valve, and an annular curved lower wall connecting the inner wall to the opposing wall, for engaging the top of a tire valve. The opposing wall has a height less than that of the inner wall. These three surfaces provide for enhanced sealing between the adaptor and the tire valve, decreasing leakage.

The flow passage includes a post centrally located within the flow passage and extending into the spout, for engaging the pin of a tire valve. The post is attached to an inner surface of the flow passage by at least one rib.

The base further comprises a flexible diaphragm connected to the first end of the tube, which is adapted to receive the actuator of an aerosol container. Sufficient pressure on the spout of the adaptor flexes the diaphragm, causing the tube of the adaptor to engage and push the actuator into the aerosol container, opening the valve of the container. Simultaneously, the post engages the tire valve pin, opening the valve. The release of pressure on the spout closes the tire valve and allows the diaphragm to return to its original position, causing the tube to allow the aerosol container valve to close.

DETAILED DESCRIPTION OF THE INVENTION

Figure 1:
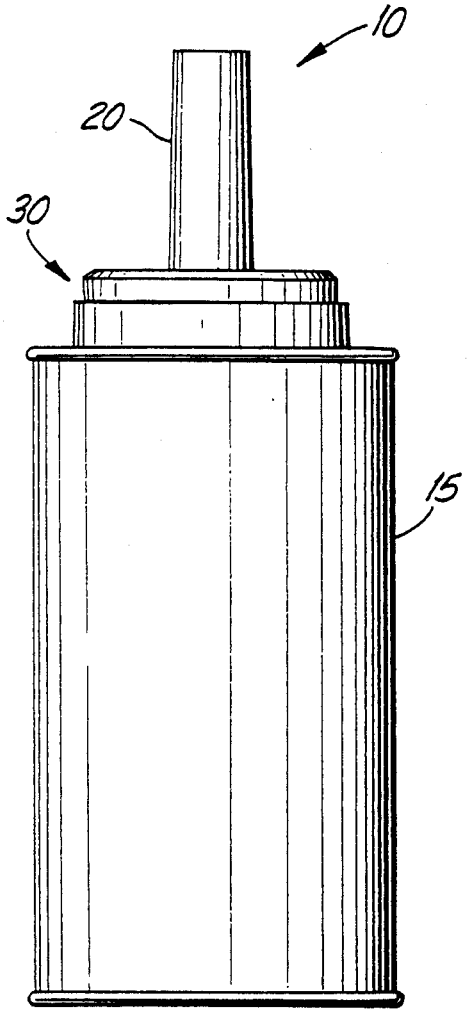
FIG. 1 is a side view of the connector device of the present invention attached to an aerosol container.

FIG. 1 shows the adaptor 10 of the present invention, attached to an aerosol container 15. The adaptor 10 comprises a hollow tube 20 and a base 30.

Figure 2:
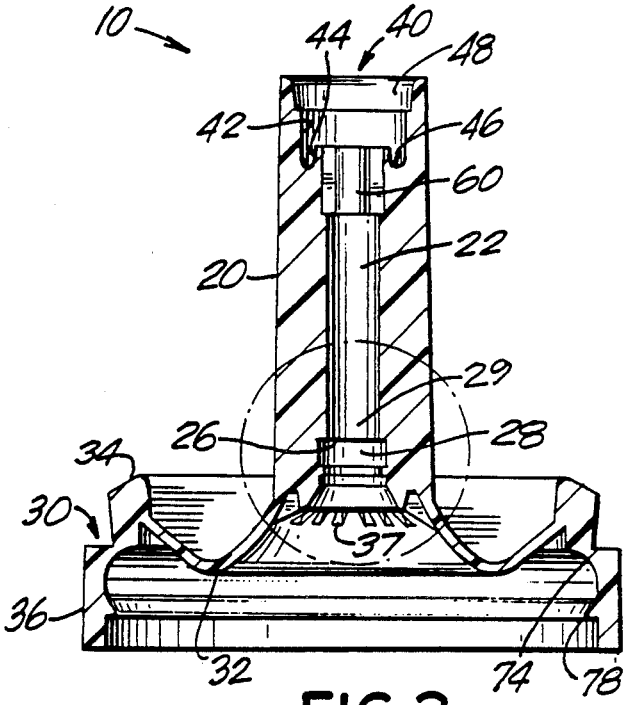
FIG. 2 is a sectional view of the connector of FIG. 1.

FIG. 2 shows a sectional view of the adaptor 10, hollow tube 20 and base 30. The hollow tube 20 comprises a flow passage 22 for conveying a hydrocarbon gas, preferably butane, from the aerosol container 15 to a tire valve. A spout 40 of the hollow tube 20 is adapted to receive the tire valve, as shown in FIG. 3.

Figure 3:
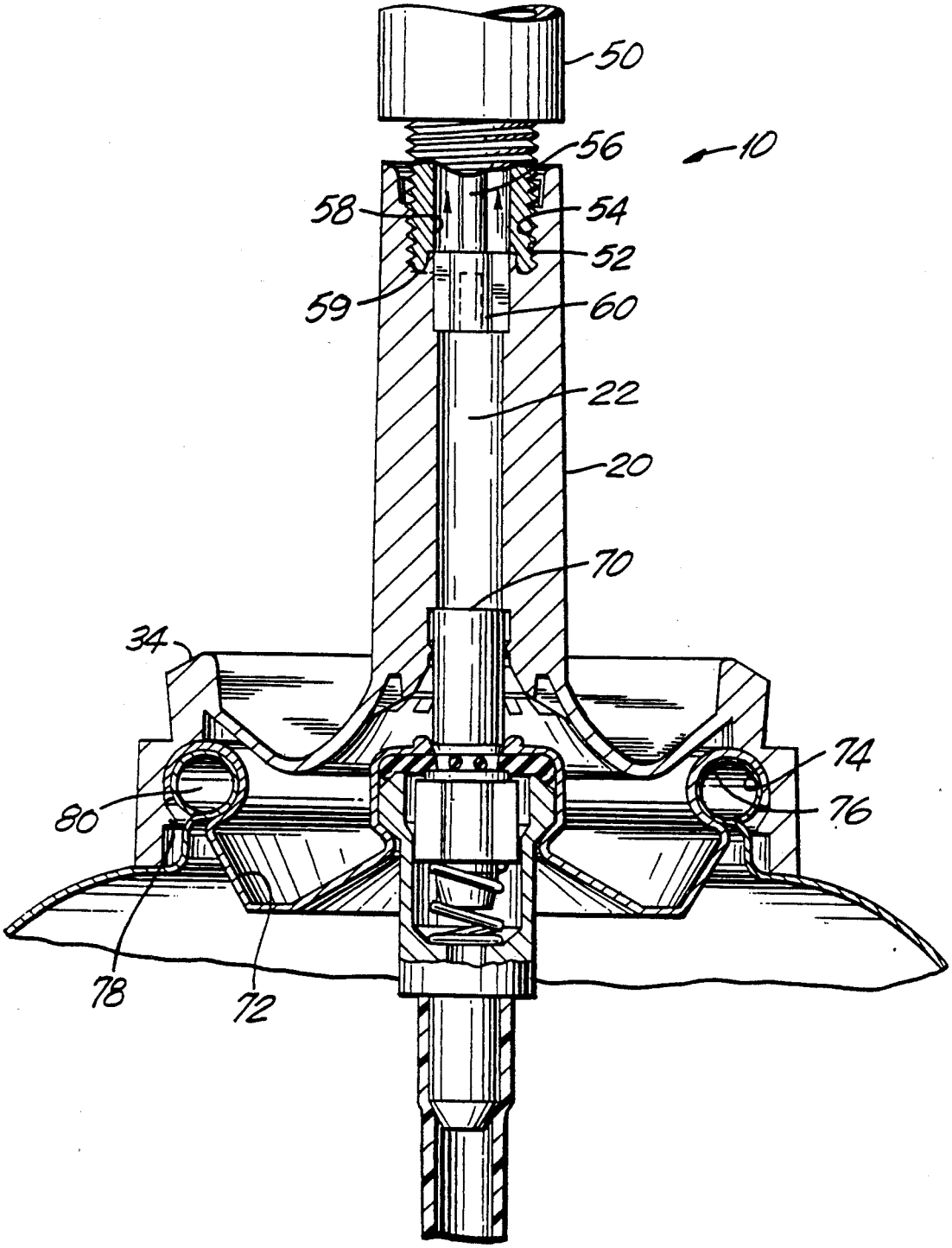
FIG. 3 is a sectional view of the connectors and mounting cup, engaging a tire valve.

FIG. 3 shows a sectional view of the adaptor 10 connected to a tire valve 50 having a pipe 52 with external threads 54 around its outer end. A stem or pin 56 lies within the pipe 52. The inner surface of the pipe is identified as 58. Depression of the pin 56 of the tire valve 50 by the adaptor 10, in the manner described below, opens the valve for inflation.

Returning to FIG. 2, the spout 40 includes sealing means to maintain an air tight seal between the tire valve 50 and the adaptor 10, preventing the escape of gas during use. A circumferential inner wall 42 is provided for engaging the threaded portion 54 of the tire valve 50, as shown in FIG. 3. A circumferential opposing wall 44 is provided for engaging an inner surface 58 of the threaded portion of the tire valve 50. The opposing wall 44 is essentially parallel to circumferential inner wall 42, and has a height less than that of the circumferential inner wall 44. By engaging three surfaces of the tire valve, as shown in FIG. 3, an air tight seal superior to that in prior art tire valves is provided. The end 48 of the spout is slightly flared to assist in the initial placement of the adaptor onto the tire valve 50. The adaptor 10 is preferably made of soft material which will conform to the threading of the tire valve, also improving sealing. A preferred self-threading thermoplastic material is polypropylene.

To adequately seal a standard tire valve, the diameter of the inner wall is preferably about 0.275 inches, the diameter of the opposing wall about 0.190 inches and the distance between these walls is preferably about 0.0425 inches. The lower wall 46 is preferably curved, with a radius of about 0.019 inches, which matches the curvature of the top of the tire pin.

Figure 4:
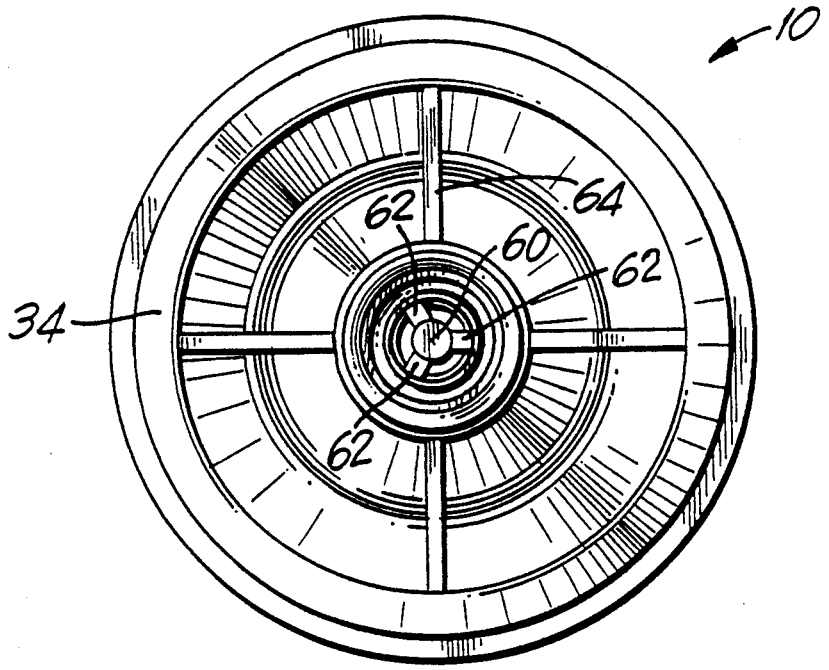
FIG. 4 is a top view of the connector of FIG. 1.

A post 60 for engaging the pin 56 of the tire valve is concentrically positioned within the flow passage 22 near the spout 40. FIG. 4 is a top view of the adaptor 10, showing the post 60, which is secured in position by a plurality of radial ribs 62 depending from the walls of the flow passage 22. The ribs 62 can be equidistantly or symmetrically placed around the post 60. Preferably, three ribs are spaced 120 ° apart, as shown in FIG. 4. The ribs maintain the post in alignment with the pin 56 of the tire valve 50 during use. FIG. 4 also shows the bottom of the lower annular wall 46.

Figure 2A:
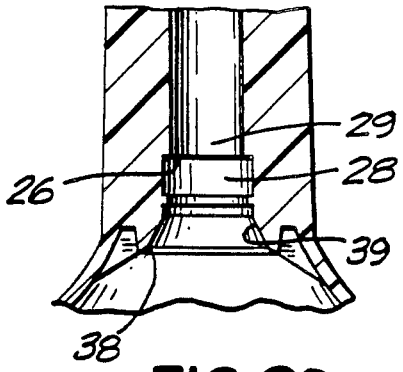
FIG. 2*a* is a close up sectional view of the circled region in FIG. 2, with certain features removed.

Returning to FIG. 2, the base 30 preferably comprises a conical, flexible diaphragm 32, depending from the tube 20. The periphery of the diaphragm is connected to a rim 34. A circumferential skirt 36 depends from the rim 34. A bottom portion 24 of the tube 20 can extend slightly through the diaphragm 32. Ribs 37 surround and converge toward the bottom portion 24 of the tube 20, for assisting in the insertion of a conventional aerosol valve actuator 70 of the aerosol container 15 into the tube 20 of the adaptor 10, when the adaptor is attached to a mounting cup 72, as shown in FIG. 3. Returning to FIG. 2, the bottom portion of the tube is slightly flared, also assisting the insertion of the actuator 70. FIG. 2*a* is a close up view of the connection between the tube 20 and diaphragm 32, with the ribs 37 removed to more clearly show the flared entrance to the tube 20. Initially, the flare is preferably 28° in the region identified as 38. This increases to about 70° in the region identified as 39.

As shown in FIGS. 2, 2*a* and 3, the tube 20 of the adaptor has an annular shoulder 26 for engaging the top of the actuator 70 of the aerosol container when it is fully inserted into the adaptor. The shoulder can be formed by decreasing the inner diameter of the flowpath 22 at that point. For example, the inner diameter of the region 28 could be about 0.158 inches, while the inner diameter of the product flowpath in region 29 is about 0.140 inches.

Figure 5:
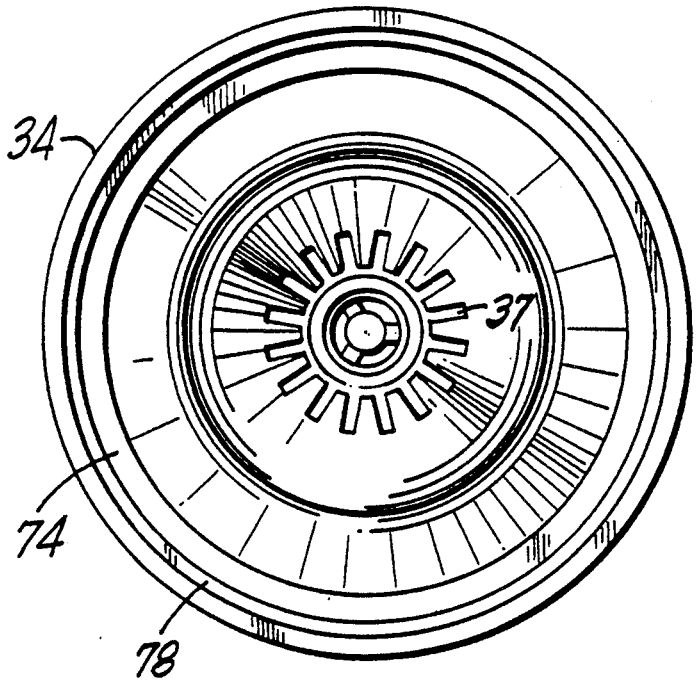
FIG. 5 is a bottom view of the connector of FIG. 1.

In FIG. 2, the base 30 of the adaptor includes an annular channel 74, formed by the bottom surface of the rim. The channel 74 is suitably dimensioned so that the shoulder 76 of a standard, mounting cup fits snugly within the channel 74 when the adaptor is attached to a bead 80 of an aerosol container, as shown in FIG. 3. The diameter of the channel 74 is therefore essentially equal to the outer diameter of the mounting cup 72. The circumferential skirt 36 includes a circumferential ridge 78 with a diameter less than the outer diameter of a standard mounting cup. The ridge 78 is located toward the bottom of the skirt 36. The distance from the top of the shoulder 76 of the mounting cup 72 to the bottom of the bead 80 of the container 15 needs to be less than the distance between the top of the annular channel 74 to the top of the circumferential ridge 78. This enables the adaptor to be "snapped" onto the mounting cup with a secure friction fit. This also prevents excessive turning of the adaptor in use. FIG. 5 shows a bottom view of the adaptor 10, including the rim 34, ribs 36, annular channel 74 and circumferential ridge 78.

Returning to FIG. 4, a plurality of wall sections 64 preferably extend from the rim 34 to the tube 20, across the diaphragm 32. These walls stabilize the tube 20 and diaphragm 32, preventing excessive lateral movement of the tube while it is in engagement with the tire valve.

In operation, the adaptor spout 20 is positioned on the tire valve 50, as shown in FIG. 3. The container can be either pushed or rotated onto the tire valve 50. The external, top and inside surfaces of the tire valve are sealed by the inner wall 42, lower wall 46, and opposing wall 44 of the adaptor 10. The inner wall conforms to the threads of the tire valve, due to the softness of the polypropylene.

Continued pressure on the can forces the top surface 59 of the tire valve 52 against the lower wall 46. This force is exerted down the tube 20, flexing the diaphragm 32. As the tube continues downward, the shoulder 26 of the tube 20 forces the actuator into the aerosol container, opening the container valve in a conventional manner, allowing pressurized gas within the container to flow through the flow passage 22.

Simultaneously, the post 60 of the adaptor 10 engages the pin 56 of the tire valve, pushing it inward, opening the tire valve. Gas can now flow from the aerosol container 15, through the flow passage 22, into the tire, or other object to be inflated.

When the tire is sufficiently filled, the container is removed, releasing the pin 56 of the tire valve, closing the valves. Similarly, the flexible diaphragm 32 returns to its original position, releasing the actuator 70, closing the container valve.

When the adaptor is removed from the tire valve, the threads formed by engagement with the tire valve disappear due to the memory of the plastic.

I claim:

1. A one piece tire valve adaptor for connection to an aerosol container comprising;

a base including a means for attachment to a mounting cup; and a hollow tube having a first end connected to said base, a second end comprising a spout for connection to a tire valve, and a flow passage extending from said first end to said second end;

said spout including a sealing means comprising a circumferential inner wall for engaging a threaded portion of the tire valve, an annular lower wall attached essentially perpendicular to said inner wall for engaging the end of the tire valve and an opposing wall attached to said lower wall, essentially parallel to said inner wall, said opposing wall being at least partially transverse to said inner wall, for engaging the inner surface of the threaded portion of the tire valve.

2. The adaptor of claim 1, wherein said flow passage includes a post centrally located within said flow passage and extending into said spout, for engaging a pin of the valve, said post being attached to an inner surface of said flow passage by at least one rib.

3. The adaptor of claim 1 or 2, wherein said base further comprises a flexible diaphragm connected to said first end of said tube, said first end adapted to receive an actuator of the aerosol container such that sufficient pressure on said spout of said adaptor flexes said diaphragm, causing said tube of said adaptor to engage and push the actuator into the aerosol container, opening a valve of the container, and the release of pressure on said spout returns said diaphragm to its original position, causing said tube to allow said valve to close.

4. The adaptor of claim 1, wherein said annular lower wall is curved.

5. The adaptor of claim 1, wherein said spout is flared.

6. The adaptor of claim 2, wherein said post is attached to said inner surface of said flow passage by a plurality of ribs positioned essentially equidistantly around said post.

7. The adaptor of claim 6, comprising three ribs.

8. The adaptor of claim 3, wherein said base further comprises a rim attached to said diaphragm and a circumferential skirt depending from said rim.

9. The adaptor of claim 8, wherein said diaphragm is concave and annular.

10. The adaptor of claim 8, wherein said diaphragm has a first part dependent and descending from said tube and a second part dependent and descending from said rim, said first and second parts being integral.

11. The adaptor of claim 8, wherein the bottom of said base comprises a plurality of grooves surrounding said opening.

12. The adaptor of claim 1 or 6, wherein said means for attachment to a mounting cup comprises an annular channel in the bottom of said base for receiving a shoulder of the mounting cup.

13. The adaptor of claim 12, wherein said annular channel is defined by the bottom of said diaphragm, said rim and said skirt.

14. The adaptor of claim 12, wherein the diameter of said channel is essentially equal to the diameter of the mounting cup.

15. The adaptor of claim 12, wherein the inner surface of said circumferential skirt comprises a circumferential ridge with an inner diameter less than the outer diameter of the mounting cup, said ridge securing the shoulder of the mounting cup within said channel.

16. The adaptor of claim 8, wherein the top of said base further comprises a plurality of wall sections extending from said rim to said first end of said tube, across and integral with said diaphragm.

17. The adaptor of claim 1, wherein said tube further comprises a circumferential ridge near said first end, along said flow passage, said ridge for engaging an actuator of the aerosol container.

18. The adaptor of claim 3, wherein said tube further comprises a circumferential ridge near said first end, along said flow passage, said ridge for engaging the actuator of the aerosol container.

19. The adaptor of claim 10, formed of self-threading, thermoplastic material.

20. The adaptor of claim 19, wherein said material is polypropylene.

21. A one piece tire valve adaptor for connection to an aerosol container comprising;

a base comprising a means for attachment to a mounting cup; and a hollow tube having a first end connected to said base, a second end comprising a spout for connection to a tire valve, and a flow passage extending from said first end to said second end; wherein said flow passage includes a post centrally located within said flow passage and extending into said spout, for engaging a pin of the tire valve, said post being attached to an inner surface of said flow passage by at least one rib;

said spout comprises a circumferential inner wall for engaging the threaded portion of the tire valve, an opposing wall essentially parallel to and partially transverse to said inner wall, for engaging the inner surface of the threaded portion of the tire valve and an annular curved lower wall connecting said inner wall to said opposing wall, for engaging the top of the tire valve; and said base further comprises a flexible diaphragm connected to said first end of said tube, such that sufficient pressure on said adaptor flexes said diaphragm, causing said tube of said adaptor to push an actuator into said aerosol container, opening a valve of said container, said fixed diaphragm returning to its original position when said pressure is relieved, allowing said container valve to close.

22. The adaptor of claim 21, wherein said flow passage includes a circumference ridge for engaging said actuator of an aerosol container when said adaptor is attached to the mounting cup of the container.

23. The adaptor of claim 22, wherein said post is attached to said inner surface of said flow passage by a plurality of ribs symmetrically positioned around said post.

24. The adaptor of claim 23, wherein said base further comprises a rim depending from said diaphragm and a circumferential skirt depending from said rim.

25. The adaptor of claim 24, wherein said diaphragm spans the distance between said rim and said tube, and is concave across the distance.

26. The adaptor of claim 25, wherein the bottom of said base comprises an annular channel defined by said diaphragm, rim and skirt, for receiving the mounting cup.

27. The adaptor of claim 26, wherein the inside surface of said skirt comprises a circumferential ridge with an inner diameter less than the outer diameter of the mounting cup.

28. The adaptor of claim 27, wherein said first end of said tube is flared.

29. The adaptor of claim 28, further comprising radial ribs in the bottom of said base, converging toward said first end.

30. The adaptor of claim 29, comprised of self-threading polypropylene.

* * * * *